US007459009B2

(12) United States Patent
Ray et al.

(10) Patent No.: US 7,459,009 B2
(45) Date of Patent: Dec. 2, 2008

(54) METHOD AND APPARATUS FOR FLUE GAS DESULPHURIZATION

(75) Inventors: Isaac Ray, Brooklyn, NY (US); Mark A. West, Deerfield, IL (US); Boris Altshuler, North Miami Beach, FL (US)

(73) Assignee: Eisenmann Corporation, Crystal Lake, IL (US)

( * ) Notice: Subject to any disclaimer, the term of this patent is extended or adjusted under 35 U.S.C. 154(b) by 330 days.

(21) Appl. No.: 11/405,809

(22) Filed: Apr. 17, 2006

(65) Prior Publication Data

US 2006/0230938 A1 Oct. 19, 2006

Related U.S. Application Data

(60) Provisional application No. 60/672,108, filed on Apr. 15, 2005.

(51) Int. Cl.
*B03C 3/014* (2006.01)

(52) U.S. Cl. ..... 95/65; 55/DIG. 38; 95/71; 95/75; 96/44; 96/47; 96/48; 96/49; 96/50; 96/53; 96/98; 96/100

(58) Field of Classification Search ..... 95/64–66, 95/71, 72, 75; 96/44–50, 52, 53, 98–100; 55/DIG. 38
See application file for complete search history.

(56) References Cited

U.S. PATENT DOCUMENTS 1,444,627 A 2/1923 Meston
2,195,431 A 4/1940 Shively et al.

FOREIGN PATENT DOCUMENTS

GB 1 485 259 A 9/1977

OTHER PUBLICATIONS

Balakrishnan, "Riley Scrubber Performance at Cilco," Presented to the Committee on Power Generation Association of Edison Illuminating Companies, Minneapolis, Minnesota, pp. 1-6 (Sep. 14, 1977).

(Continued)

*Primary Examiner*—Richard L Chiesa
(74) *Attorney, Agent, or Firm*—Drinker Biddle & Reath LLP

(57) ABSTRACT

An apparatus for removing particulate matter from a gas stream containing particulate matter, the apparatus including: a mist-producing element that mixes a gas stream entering the apparatus with liquid droplets; and a down flow Wet Electrostatic Precipitator (WESP) pass section having ionizing electrodes that electrically charge the particulate matter and the intermixed liquid droplets, and collecting surfaces in the form of an array of polygonal tubes, wherein the collecting surfaces are under the influence of an electrical field to attract and remove electrically-charged particulate matter and intermixed liquid droplets from the gas stream. An embodiment utilizing two down-flow Wet Electrostatic Precipitator (WESP) sections (i.e., a first pass section and a second pass section), each of which includes ionizing electrodes that electrically charge the particulate matter and the intermixed liquid droplets, and collecting surfaces in the form of an array of polygonal tubes, wherein the collecting surfaces are under the influence of an electrical field to attract and remove electrically-charged particulate matter and intermixed liquid droplets from the gas stream is also disclosed, as is a method for removing particulate matter.

(Continued)

14 Claims, 3 Drawing Sheets

U.S. PATENT DOCUMENTS

| | | | | |
|---|---|---|---|---|
| 2,592,508 | A | 4/1952 | Phyl | |
| 2,937,709 | A | 5/1960 | De Seversky | |
| 3,124,437 | A | 3/1964 | Lagarias | |
| 3,248,857 | A | 5/1966 | Weindel et al. | |
| 3,765,154 | A | 10/1973 | Hardt et al. | |
| 3,831,351 | A | 8/1974 | Gibbs et al. | |
| 3,907,526 | A | 9/1975 | Saleem et al. | |
| 3,958,958 | A | 5/1976 | Klugman et al. | |
| 3,958,960 | A | 5/1976 | Bakke | |
| 3,958,961 | A | 5/1976 | Bakke | |
| 4,049,399 | A | 9/1977 | Teller | |
| 4,072,477 | A | 2/1978 | Hanson et al. | |
| 4,355,108 | A | 10/1982 | Gaddy et al. | |
| 4,364,910 | A | 12/1982 | Willett et al. | |
| 4,523,928 | A | 6/1985 | Hillman et al. | |
| 4,844,723 | A | 7/1989 | Tellini et al. | |
| 4,870,045 | A | 9/1989 | Gasper et al. | |
| 5,084,072 | A | 1/1992 | Reynolds | |
| 5,137,546 | A | 8/1992 | Steinbacher et al. | |
| 5,154,734 | A | 10/1992 | Yung | |
| 5,525,317 | A | 6/1996 | Bhat et al. | |
| 5,624,476 | A | 4/1997 | Eyraud | |
| 6,117,403 | A | 9/2000 | Alix et al. | |
| 6,132,692 | A | 10/2000 | Alix et al. | |
| 6,193,782 | B1 * | 2/2001 | Ray | 95/4 |
| 6,224,653 | B1 | 5/2001 | Shvedchikov et al. | |
| 6,231,643 | B1 | 5/2001 | Pasic et al. | |
| 6,294,003 | B1 * | 9/2001 | Ray | 96/49 |
| 6,302,945 | B1 | 10/2001 | Altman et al. | |
| 6,488,740 | B1 | 12/2002 | Patel et al. | |
| 6,558,454 | B1 | 5/2003 | Chang et al. | |
| 6,649,132 | B1 | 11/2003 | Hwang et al. | |
| 7,270,698 | B2 * | 9/2007 | Tanaka et al. | 96/95 |
| 7,297,182 | B2 * | 11/2007 | Ray et al. | 95/64 |
| 7,318,857 | B2 * | 1/2008 | Ray et al. | 96/44 |
| 7,332,020 | B2 * | 2/2008 | Tanaka et al. | 96/66 |
| 2002/0061270 | A1 | 5/2002 | Osborne | |
| 2002/0164730 | A1 | 11/2002 | Ballesteros Perdices et al. | |
| 2004/0040438 | A1 | 3/2004 | Baldrey et al. | |
| 2004/0121436 | A1 | 6/2004 | Blount | |
| 2005/0112056 | A1 | 5/2005 | Hampden-Smith et al. | |
| 2005/0220695 | A1 | 10/2005 | Abatzoglou et al. | |
| 2007/0079704 | A1 * | 4/2007 | McAnespie | 96/53 |

OTHER PUBLICATIONS

Staehle, "Control of Fine Particulates and Acid Mist by Use of Wet Electrostatic Precipitation," The Babcock & Wilcox Company, pp. 1-23 (2004).

* cited by examiner

METHOD AND APPARATUS FOR FLUE GAS DESULPHURIZATION

CROSS-REFERENCE TO RELATED PATENT APPLICATIONS

This patent application claims the benefit of U.S. Provisional Patent Application No. 60/672,108, filed Apr. 15, 2005.

FIELD OF THE INVENTION

This invention pertains to a Wet Electrostatic Precipitator (WESP) apparatus and method for removing particulate matter from a gas stream and to an apparatus having the capacity for continuous self-cleaning of the collecting surface of the apparatus from collected particulate matter while minimizing or eliminating fine mist leaving or exiting from the apparatus.

BACKGROUND OF THE INVENTION

There have been continuing attempts to improve techniques for removing fine particulates from gas streams. Among the recent improvements is the utilization of condensing wet electrostatic precipitators wherein the particulates carried by an incoming gas stream are entrained in condensate formed on walls of the precipitator and are flushed from the walls for collection. Also known is a down-flow type of WESP in which the water droplets move concurrently with the gas.

Despite such improvements, however, there remains a need for improved and cost effective apparatuses and methods for eliminating all or substantially all of a particulate matter from a gas stream, while continuously cleaning the collecting surface.

BRIEF SUMMARY OF THE INVENTION

The invention provides an apparatus for removing particulate matter from a gas stream. The inventive apparatus includes a mist-producing element that mixes a gas stream entering the apparatus with liquid droplets, and a single down-flow Wet Electrostatic Precipitator (WESP) section referred to as a pass section. The pass section has: (a) an ionizing electrode stage that electrically charges the particulate matter and the intermixed liquid droplets; and (b) a collecting surfaces stage in the form of an array of polygonal tubes, wherein the collecting surfaces, under the influence of an electrical field, attract and remove electrically-charged particulate matter and intermixed liquid droplets from the gas stream.

In another embodiment, two down-flow Wet Electrostatic Precipitator (WESP) sections referred to herein as a "first pass" and a "second pass" are connected in a series arrangement. Each of the first and second passes has: (a) an ionizing electrode stage that electrically charges the particulate matter and the intermixed liquid droplets; and (b) a collecting surfaces stage in the form of an array of polygonal tubes, wherein the collecting surfaces, under the influence of an electrical field, attract and remove electrically-charged particulate matter and intermixed liquid droplets from the gas stream.

DETAILED DESCRIPTION OF THE INVENTION

Figure 2B:
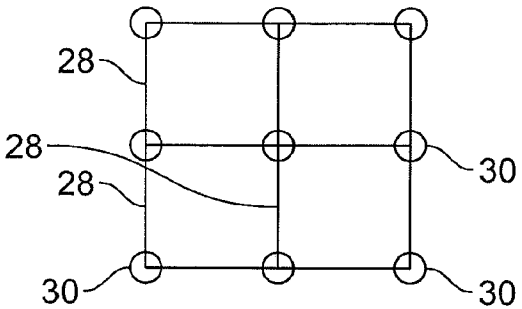
FIG. 2B is a top view of a portion of the collector having an array of square tubes.
Figure 2A:
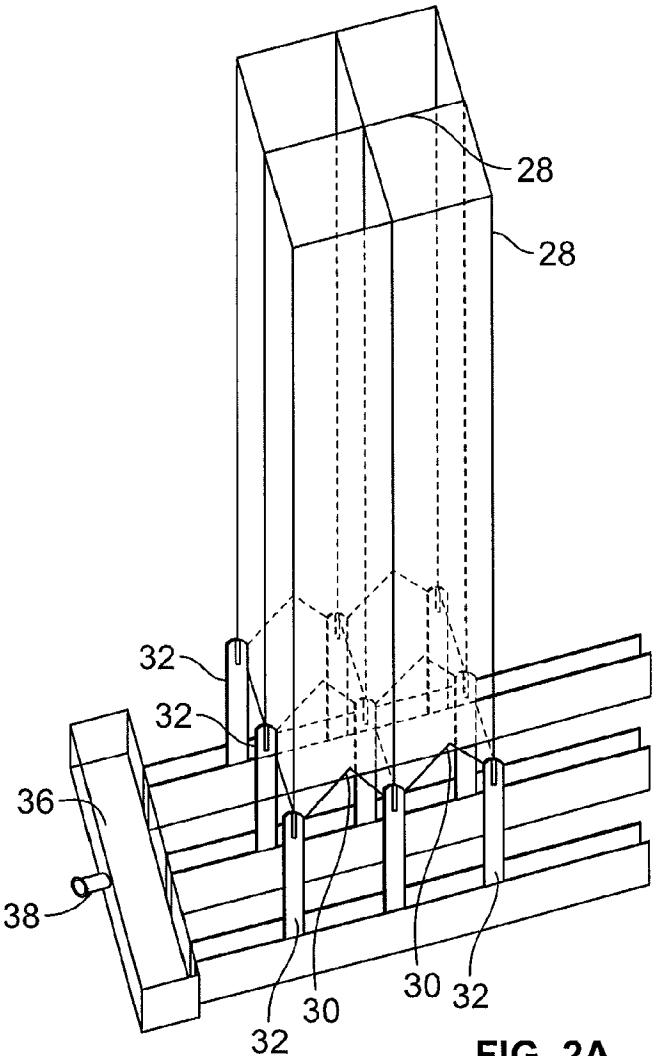
FIG. 2A is a perspective showing a portion of an apparatus comprising a collector having an array of square tubes and constructed in accordance with an embodiment of the present invention.
Figure 3:
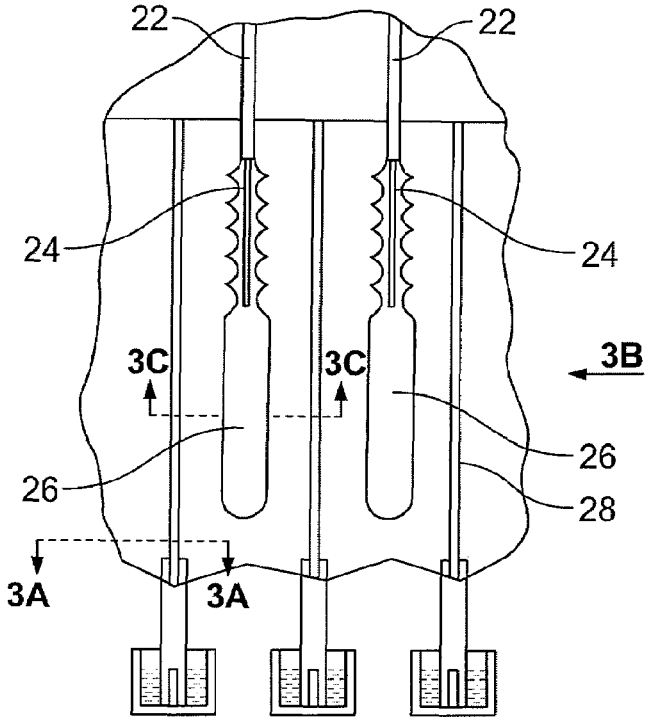
FIG. 3 is a schematic, fragmentary view of the apparatus of FIG. 1 illustrating various components in greater detail.

An exemplary apparatus 10 having features according to the present invention is illustrated in FIGS. 1-3, and 3A-C. The apparatus 10 includes a "first pass" 11 having an inlet transition 12 with gas distribution perforated plate 14, fine liquid mist nozzles 16, support structure for ionizing electrodes 18, support insulators 20, ionizing electrodes 22, which have a charging stage 24 with sharp corona generating points and smooth collecting stage 26, as shown in FIG. 3.

Figure 1:
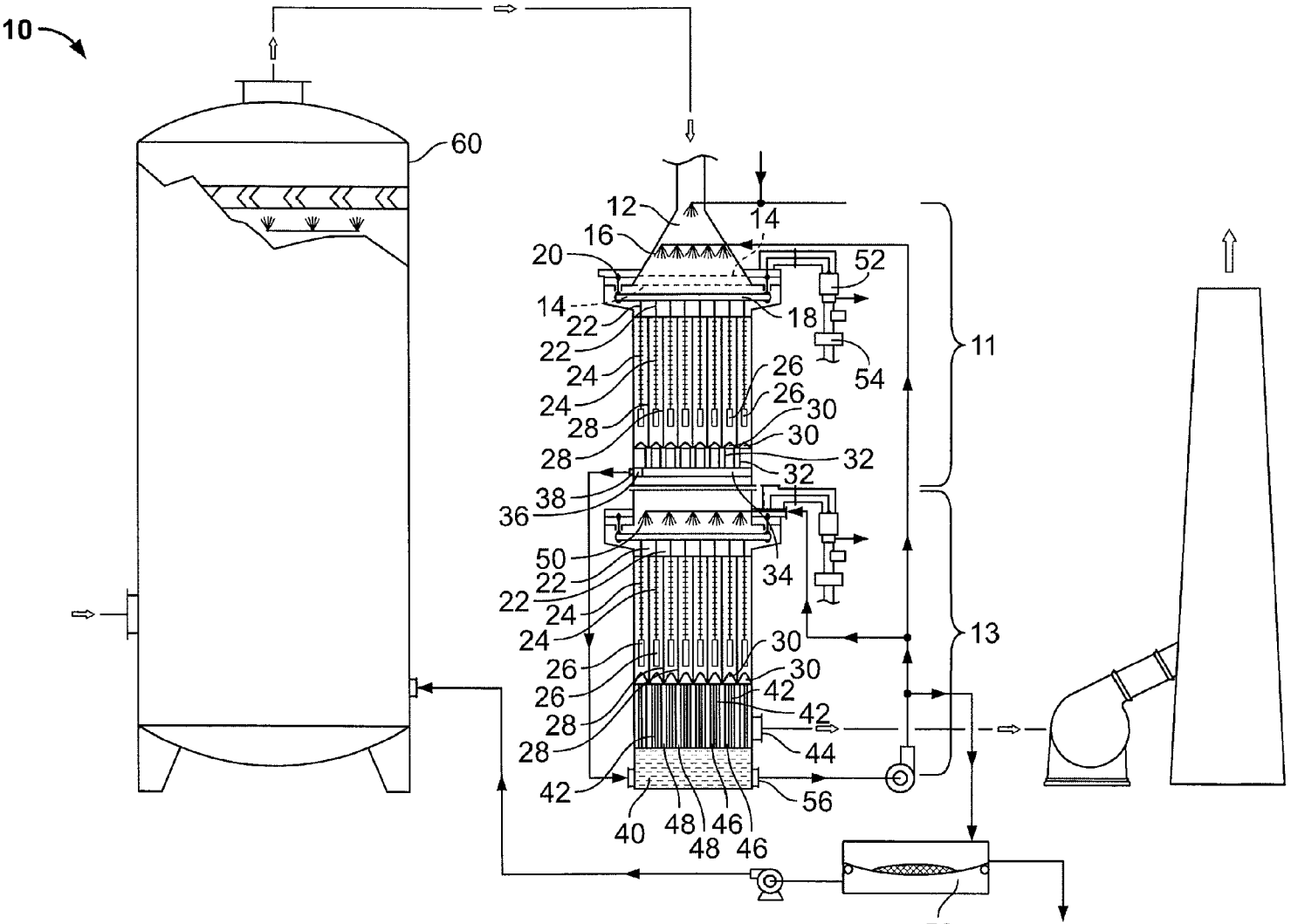
FIG. 1 is a schematic view of an apparatus constructed in accordance with an embodiment of the present invention.

The ionizing electrodes 22 of the apparatus 10 are preferably located centrally in the spaces defined by the collecting surfaces 28 ("collectors"), which are also illustrated in FIG. 2. The collectors 28 are preferably constructed as an array of square tubes, each having a bottom edge having a V-shape cutout 30, as shown in FIGS. 2A and 3B. This cutout 30 provides for a "gutter effect" in directing collected liquid into the corners of the square tubes and, further down, via draining tubular leaders 32, into channels 34 of the interstage drain and then out from the apparatus 10 via manifold channel 36 and nozzle 38, as shown in FIG. 2A, and down to the sump 40 at the bottom of the mist eliminator, as shown in FIG. 1.

In a second embodiment, the mist elimination apparatus 10 also includes a "second pass" 13. As illustrated in FIG. 1, the second pass can have generally the same design as the first pass, except, for example, that leaders 42 from the collecting tubes 28 preferably reach sump 40 and the gas, after exiting from the collecting tubes 28, turns 90° and horizontally exits the apparatus 10 through outlet nozzle 44. Before exiting the apparatus 10, the gas stream intersects the array of tubes 42 and tubes 46, which are located in staggered position in relation to leader tubes 42. Tubes 42 and tubes 46, in this regard, have mist-eliminating blades 48 that, at the same time, provide additional surface for elemental mercury precipitation. Flushing sprays 50 can be used for periodic flushing of the second pass, and high voltage power can be supplied by the power supply 52 and 54.

The collected liquid is drained from the apparatus via nozzle 56 and then passed through a deep bed filter 58, after which all liquid that is free from solids of ash, heavy metals, and mercury is directed into a flue gas desulphurization (FGD) scrubber sump 60.

When in operation, an incoming gas stream laden with solid particulates and acid gases enters the apparatus 10 through inlet transition 12, which incorporates perforated plates 14 for gas distribution and fog nozzle 16, which provides a fine liquid mist that can include any soluble sulfide salts, such as, for example, sodium hydrosulfide solution. Upon entering the first pass of the down-flow Wet Electrostatic Precipitator (WESP) section, the solid particles along with liquid droplets are charged in an ionizing stage where sharp points 24 of the ionizing electrodes 18 create a flow of negative ions. Under the influence of the electrical field, the charged particles and droplets, together, migrate towards collecting surfaces 28.

The collection process is more effective in the repelling stage where the high voltage field is uniform between collecting walls 28 and repeller 26. Most of the sparking and arcing takes place between sharp points 24 and the walls of the collector 28. Practically no sparking takes place that minimizes the production of small droplets in the space between smooth repeller 26 and collector walls 28 in the second pass (as discussed below).

Figure 3A:
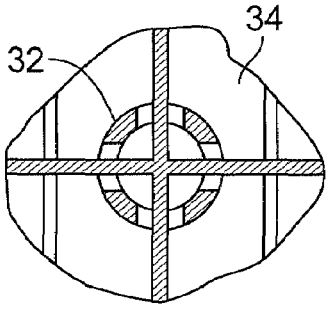
FIG. 3A is a fragmentary cross-sectional view taken generally along line 3A-3A of FIG. 3.
Figure 3B:
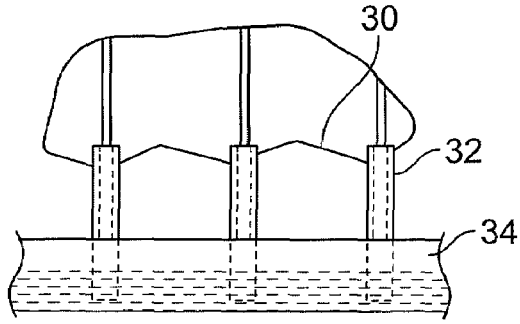
FIG. 3B is a fragmentary cross-sectional view taken generally along line viewed in direction 3B indicated in FIG. 3.

The mixture of collected particles and water droplets moves continuously downward under the forces of gravity and is directed by V-shape gutters 30 and leader tubes 32 within the vertical slots into the collecting channels 34, as shown in FIGS. 2A, 2B, and 3A. From there, the liquid flows into the manifold channel 36, and then via nozzle 38 down to the sump 40.

The use of polygonal collecting tubes 28 in the down-flow WESP provides for liquid collection in the corners of the tubes 28 when the liquid moves down under the gravity. In particular, the droplets may at first collect evenly around all surfaces of the tubes 28 after being charged, however, as gravity pulls them down, some of the water gets into the corners of the polygonal tubes 28 and is captured. Eventually, all or substantially all of the water may be collected in the corners of the polygonal tubes 28. The position of the point of complete collection depends upon the ratio between the width of the tube side and the length of the tube. This is attributable, at least in part, to the laws of the surface tension in the liquid stream. Moreover, in order to improve the liquid distribution on polygonal tube walls 28, trace amounts of one or more surfactants can be added to the spray liquid. The gas can pass (without changing direction) into the second pass of the mist eliminator.

After passing through the first pass of the mist eliminator of the apparatus 10, the gas will be substantially free of most of the contaminating solid particles, acid, and scrubbing liquid droplets. The gas then enters the second pass of the mist eliminator of the apparatus 10 for final removal of the remaining droplets, submicron particles of heavy metals, and oxidized mercury, as well as elemental mercury via a "freezing" process in the presence of ozone generated in the first pass WESP.

Figure 3C:
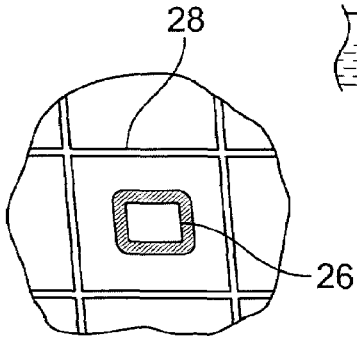
FIG. 3C is a fragmentary cross-sectional view as taken generally along line 3C-3C of FIG. 3.

The process of gas cleaning in the second pass of the mist eliminator of the apparatus 10 can be similar to the process in the first pass except that there is no concurrent spraying of a water mist. Instead, the submicron droplets of water that are generated during the sparking in the first pass can provide continuous cleaning action in the second pass when they are collected on walls 28. In this regard, liquid having a small amount of solids therein can collect in the corners of polygonal or square tubes 28 in the second pass when directed there (i) by the special shape (e.g., square shape) of the repeller 26, as shown in FIG. 3C, in order to keep the intensity of the electrical field uniform in the square tube 28, and (ii) by the tapered shape in the direction of the tubes' V-shape corners. The liquid can then move further down into the sump 40 by the draining tubes 32 located in the intersection of the collecting walls, in a manner similar to the process in the first pass, except that in the second pass the interstage channels 34 are not required since the liquid is directed into the sump.

In an embodiment of the invention, tubes in the bottom pass, located in the center of each collecting tube 28 (e.g., in the form of an array of vertical tubes) can have, in addition to the draining tubes in the corners of the collecting tubes, diverting blades in order to provide additional removal of droplets and additional surface for mercury removal (e.g., by serving as an additional surface for elemental mercury precipitation).

In one embodiment, most of the electrical energy in the first pass is used for charging the particles and water droplets while a smaller portion is used for collection. In the second pass, however, collection is preferably emphasized, because most of the droplets and particles that penetrated the second pass from the first pass are already charged. This different operational emphasis between the first and second pass can be achieved by designing the ionizing electrodes 18 so that there are a greater number of sharp points 24 in the first pass but longer and larger size repeller 26 in the second pass.

In one particular embodiment, the ionizing electrodes 18 in the first pass are provided with a greater number of sharp points 24 and smaller collection repeller 26 than the second or last pass. In this embodiment, the second or last pass is provided with an ionizing electrode 18 having most of its length designed as the repeller 26 with smooth surface and of square shape for the square collecting tube 28 so as to provide for better uniformity of electrical field.

The ratio between the space devoted to the sharp points 24 and that devoted to smooth repelling portions 26 can be calculated based on the inlet loading of the sulfuric acid and liquid mist from the scrubber. Moreover, the size and the number of passes can be calculated based on the efficiency required. The larger size repeller 26 (e, g., about ⅓ of the size of the tube 28) can raise the intensity of the high voltage field and the efficiency of particulate removal without requiring additional electrical energy. Additionally, the first pass of the WESP can be powered by a high voltage power supply 52 that provides the best conditions for non-thermal plasma generation with substantial production of ozone, in addition to the conventional electrostatic precipitation, if required for the oxidation of the Mercury or $NO_x$.

In still another embodiment, the high velocity compact and efficient down-flow mist eliminator of the apparatus 10 is situated in the vertical space available from the outlet of the flue gas desulphurization (FGD) scrubber 60 down to the ground level. This space might otherwise only be used for the down coming duct. The availability of an abundant vertical space allows for greater velocity (e.g., two times higher) with longer tubes and several passes in series.

In accordance with another embodiment of the present invention, each of the WESP passes of the apparatus 10 may be equipped with its own power supply that will be selected according to the required operating voltage and current and inlet process conditions. This is because the processes with a high inlet load of acid and droplets create Corona Current Suppression that will lower WESP efficiency with single power supply.

In still another embodiment of the invention, each of the WESP sections is constructed in a polygonal tubular (e.g., square) manner and the liquid delivery method on the collecting surface can be either as a fog from the spray nozzles or liquid film with constant liquid delivery-rate.

In yet another embodiment of the invention, the first pass of the down-flow section of the WESP becomes a wet non-thermal plasma generator when it is connected to a special type of high voltage power supply that provides pulsed voltage with special characteristics, such as high pulse with fast rise and short duration. In this embodiment, non-thermal plasma can convert, for example, elemental mercury that has penetrated the FGD scrubber, to mercury oxide solids which can be removed by the second pass WESP; and precipitate elemental mercury vapors dissolved in the captured liquid utilizing the process of freezing mercury vapor on the surface of the vessel when the liquid contains even traces of the ozone ($O_3$) in the bottom sump 40, as described, for example, in B. V. Nekrasov, *Fundamentals of General Chemistry*, vol. 2, p. 343 (Moscow, 1969).

In accordance with another embodiment of the invention, the captured liquid and solids from the first pass interstage drain, which is enriched with the ozone produced in the Corona discharge of the WESP, are directed into the sump 40 in the bottom of the apparatus 10 where the precipitation of the elemental mercury is taking place and the presence of solids is increasing the total precipitation surface for mercury.

In still another embodiment of the invention, a make-up liquid can be introduced into the FGD system as a mist is sprayed into the first pass of the mist eliminator with the addition of a solution of sodium hydrosulfide (NaHS) or sodium sulfide ($Na_2S$), in order to promote the precipitation and removal from the liquid collected mercury.

In another embodiment, the bleed from the mist eliminator is treated in the deep bed filter 58 before it is introduced into the sump of the FGD scrubber 60. Moreover, in order to promote the same precipitation of mercury in the scrubber 60 and to make up for some loss of the chemicals, those chemicals can be added into the bleed line after the deep bed filter 58. Moreover, in the event that there is an oxidizer for $NO_x$ removal in the system upstream from the FGD scrubber 60 (such as SCR or barrier discharge) that can increase the concentration of the $H_2SO_4$, then sodium hydroxide (NaOH) can be added to the chemicals in the mist spray into the first pass solution for acid neutralization.

In one embodiment of the invention, the apparatus 10 comprises a mist eliminator having two passes of a down-flow tubular WESP with polygonal (e.g., square) tubes 28, into which a contaminated gas enters from the top of the first pass after making a 180° turn from the outlet of the FGD tower 60.

The inventive apparatus 10 can be used for any suitable purpose. In particular, the apparatus 10 can be used for removing droplets of scrubbing liquid (or mist), sulfuric acid mist, submicron particles of ash and heavy metals, and oxidized and elemental mercury from a gas stream that is exiting in a $SO_2$ scrubber at a coal burning power plant or other combustion process.

The inventive apparatus 10 provides for extremely effective and efficient mist elimination for a (FGD) scrubber 60, which allows for savings in capital and in operating costs. Furthermore, the apparatus eliminates problems associated with the prior art such as: the presence of contaminated fine mist (e.g., droplets smaller than 15 microns in diameter) that form via the interaction of $SO_3$ with water vapor (the "sulphuric-acid plume problem"); the need for periodic flushing and shutdown; and the development of corrosion in the system due to prolonged contact between wet/dry interfaces and collected chemicals.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments would become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An apparatus for removing particulate matter from a gas stream downstream of a flue gas desulphurization (FGD) scrubber, the apparatus comprised of:

a mist-producing element located in an inlet to the apparatus;

a down-flow wet Electrostatic Precipitator (WESP) first pass section in flow communication with the inlet, and a down-flow WESP second pass section in flow communication with the first pass section;

an ionizing electrode stage located in each of the first and second pass sections;

a plurality of collecting surfaces in the form of an array of polygonal-shaped tubes located in each of the sections, each wall of said polygonal-shaped tubes having a bottom edge defining a V-shape cut-out creating gutter and tubular shape leaders;

an interstage drain located at the bottom of each pass section; and a first high voltage power supply electrically connected to the first pass section; and a second high voltage power supply electrically connected to the second pass section.

2. The apparatus of claim 1, wherein:

the ionizing electrode stage includes a plurality of electrodes; and each of said plurality of ionizing electrodes is surrounded by a collecting surface in the form of a polygonal-shaped tube.

3. The apparatus of claim 2, wherein each wall of said polygonal-shaped tubes has a bottom edge defining a V-shape cut-out creating gutter and tubular-shaped leaders.

4. The apparatus of claim 3, wherein the gutter and tubular-shaped leaders direct the flow of liquid to an interstage drain.

5. The apparatus of claim 1, wherein the high voltage power supply has the ability to provide high voltage pulses of fast rising and short duration for non-thermal plasma generation.

6. The apparatus of claim 1, wherein the particulate matter includes acid and mercury vapors.

7. The apparatus of claim 1, wherein the first pass section is located directly above the second pass section.

8. An apparatus for removing particulate matter from a gas stream downstream of a flue gas desulphurization (FGD) scrubber, the apparatus comprised of:

a mist-producing element located in an inlet to the apparatus;

a single down-flow wet Electrostatic Precipitator (WESP) pass section in flow communication with the inlet;

an ionizing electrode stage located in the pass section;

a plurality of collecting surfaces in the form of an array of polygonal-shaped tubes located in each of the pass section, each wall of said polygonal-shaped tubes having a bottom edge defining a V-shape cut-out creating gutter and tubular shape leaders;

an interstage drain located at the bottom of the pass section; and a high voltage power supply electrically connected to the pass section.

9. The apparatus of claim 8, wherein:

the ionizing electrode stage includes a plurality of electrodes; and each of said plurality of ionizing electrodes is surrounded by a collecting surface in the form of a polygonal-shaped tube.

10. The apparatus of claim 9, wherein each wall of said polygonal-shaped tubes has a bottom edge defining a V-shape cut-out creating gutter and tubular-shaped leaders.

11. The apparatus of claim 10, wherein the gutter and tubular-shaped leaders direct the flow of liquid to an interstage drain.

12. The apparatus of claim 8, wherein the high voltage power supply has the ability to provide high voltage pulses of fast rising and short duration for non-thermal plasma generation.

13. The apparatus of claim 8, wherein the particulate matter includes acid and mercury vapors.

14. A method for removing particulate matter from a gas stream exiting a flue gas desulphurization (FGD) scrubber, the method comprised of:

directing a contaminated gas stream from the FGD scrubber into an inlet portion of a housing;

spraying a fine liquid mist into the contaminated gas stream;

electrically charging particulate matter in the gas stream by passing the gas stream by at least one ionizing electrode;

collecting the electrically charged particulate matter and droplets on a collecting surface having a bottom edge defining a V-shape cutout; and directing the electrically charged particulate matter and droplets through a gutter defined by the V-shaped cutout into a drain.

* * * * *